US005324088A

United States Patent [19]

Iio et al.

[11] Patent Number: 5,324,088

[45] Date of Patent: Jun. 28, 1994

[54] SUSPENSION APPARATUS

[75] Inventors: Tsukasa Iio; Takayoshi Ishikawa, both of Fukuyama, Japan

[73] Assignee: Mitsubishi Denki Kabushiki Kaisha, Tokyo, Japan

[21] Appl. No.: 21,047

[22] Filed: Feb. 23, 1993

[30] Foreign Application Priority Data

Feb. 25, 1992 [JP] Japan ..... 4-037816

[51] Int. Cl.[5] ..... B66C 1/36; B65D 51/00

[52] U.S. Cl. ..... 294/68.3; 294/82.17

[58] Field of Search ..... 294/67.1, 67.3, 68.1, 294/68.3, 81.51, 81.56, 82.13, 82.17, 82.19, 82.2; 220/1.5

[56] References Cited

U.S. PATENT DOCUMENTS

| | | | |
|---|---|---|---|
| 815,452 | 3/1906 | Maynard | 294/82.13 |
| 2,589,954 | 3/1952 | Neil . | |
| 3,339,764 | 9/1967 | Stanfield . | |
| 3,343,861 | 9/1967 | Sinicki . | |
| 3,809,270 | 5/1974 | Peltonen | 294/81.51 X |
| 4,277,093 | 7/1981 | Turley et al. . | |
| 4,427,228 | 1/1984 | Mattila | 294/82.2 X |
| 4,518,185 | 5/1985 | Shiffer | 294/67.1 |
| 4,546,891 | 10/1985 | Lanigan, Sr. et al. | 294/67.1 X |
| 4,728,136 | 3/1988 | Newhouse et al. | 294/68.3 |

FOREIGN PATENT DOCUMENTS

| | | |
|---|---|---|
| 3111634 | 10/1982 | Fed. Rep. of Germany . |
| 2041428 | 1/1971 | France . |
| 51-85440 | 7/1976 | Japan . |
| 2171141 | 8/1986 | United Kingdom . |

*Primary Examiner*—Dean J. Kramer

*Attorney, Agent, or Firm*—Burns, Doane, Swecker & Mathis

[57] ABSTRACT

A suspension apparatus for suspending a truck-type circuit breaker or the like when the circuit breaker is put on or taken off a truck of a switchboard frame comprises a suspension adapter to be engaged with a first hollow provided on a side face of the circuit breaker and a stopper provided on the suspension adapter to be engaged with a second hollow provided on a top face of the circuit breaker.

8 Claims, 7 Drawing Sheets

SUSPENSION APPARATUS

BACKGROUND OF THE INVENTION

1. Field of the Invention

The present invention relates to a suspension apparatus to be used for suspending a truck-type circuit breaker or the like when the circuit breaker is put on or taken off of the truck of a switchboard frame.

2. Description of the Prior Art

A conventional suspension apparatus, which is to be used for suspending a truck-type circuit breaker or the like, is described referring to FIGS. 6 and 7. FIG. 6 is a perspective view for showing the truck-type circuit breaker or the like which is suspended by a conventional suspension apparatus. FIG. 7 is a partial sectional side view showing the constitution of a hook part taken along line VII—VII in FIG. 6.

As is obvious from the figures, a pair of hollows 2 are provided on both side faces of a truck-type circuit breaker 1. As shown in FIG. 7, each hollow 2 is overhanged toward the bottom of the circuit breaker. A pair of suspension adapters 3, which have a substantially J-shaped section, are respectively engaged with the hollows 2 from below. Each suspension adapter 3 has a hole 4, so that a rope or wire 5 is tied to the adapter 3 through the hole 4.

For suspending the circuit breaker 1 by the conventional suspension apparatus, once the circuit breaker 1 is put on a truck of a switchboard frame or a floor, the rope or wire 5 is loosened, and thereby, the suspension adapters 3 are disengaged from the hollows 2 of the circuit breaker 1. Therefore, disengaged suspension adapters 3 have to be re-engaged with the hollows 2 for re-suspending the circuit breaker 1.

SUMMARY OF THE INVENTION

The purpose of the present invention is to solve the above-mentioned problems and to provide an improved suspension apparatus wherein the suspension adapters may not be disengaged from the hollows of the object to be suspended even when the rope or wire which is tied to the suspension adapters is loosened.

A suspension apparatus in accordance with the present invention comprises:

- a pair of first hollows respectively provided on both side faces of an object to be suspended;
- a pair of second hollows respectively provided on an upper face of the object in the vicinity of both boundaries between a top face and the side faces of the object;
- a pair of suspension adapters each having a hook to be engaged with the first hollow provided at an end thereof and means for trying a rope or wire being tied in the vicinity of the end; and
- a pair of stoppers respectively provided on the suspension adapter for engaging with the second hollow.

When the suspension adapters are engaged with the first hollows of the object to be suspended, the stopper means such as hooks or plate springs are respectively engaged with the second hollows. Therefore, even when the rope or wire is loosened, the suspension adapters are firmly coupled to the object.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

Figure 1:
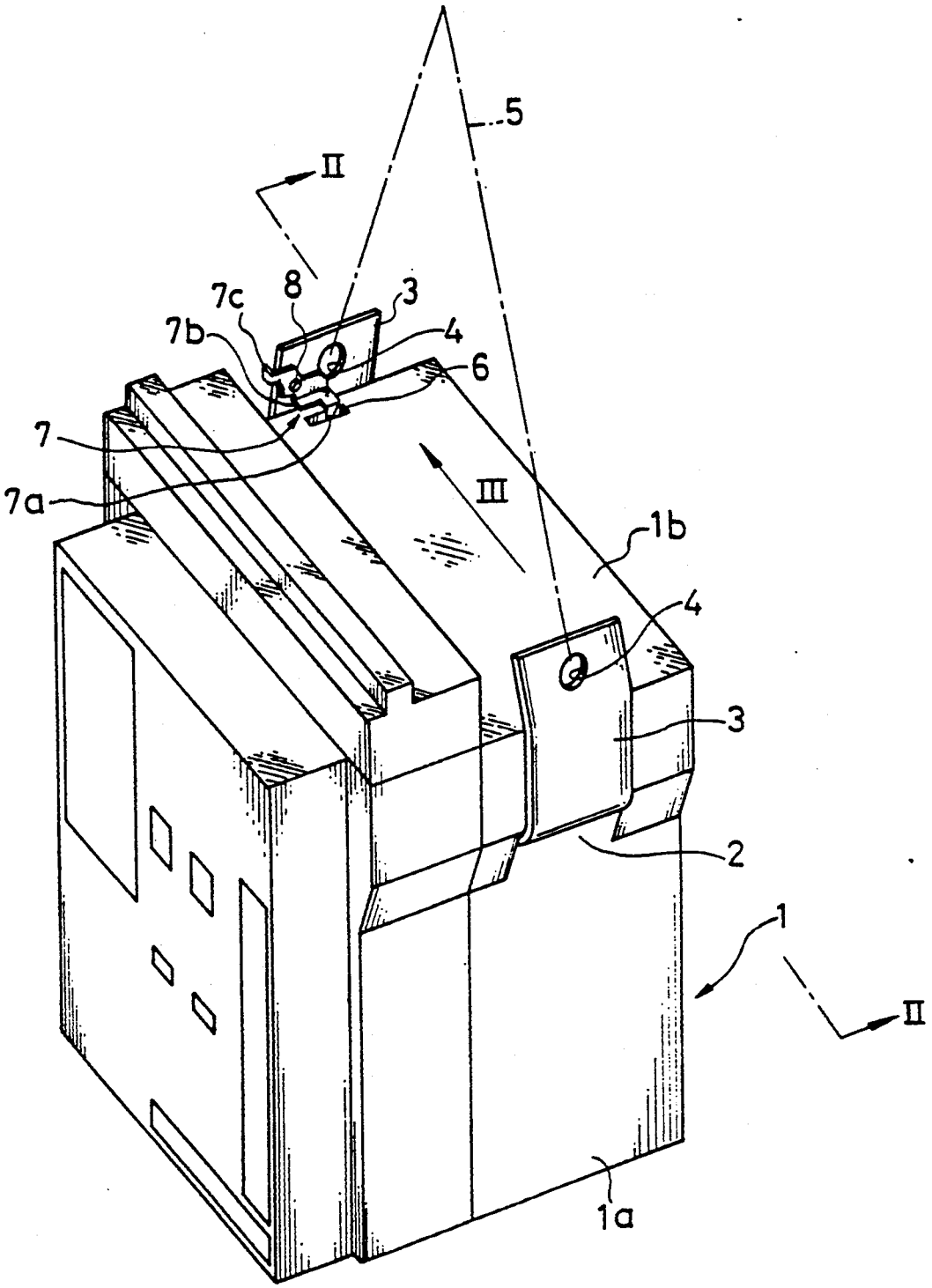
FIG. 1 is a perspective view showing a suspension of an object by using a first embodiment of a suspension apparatus in accordance with the present invention.
Figure 2:
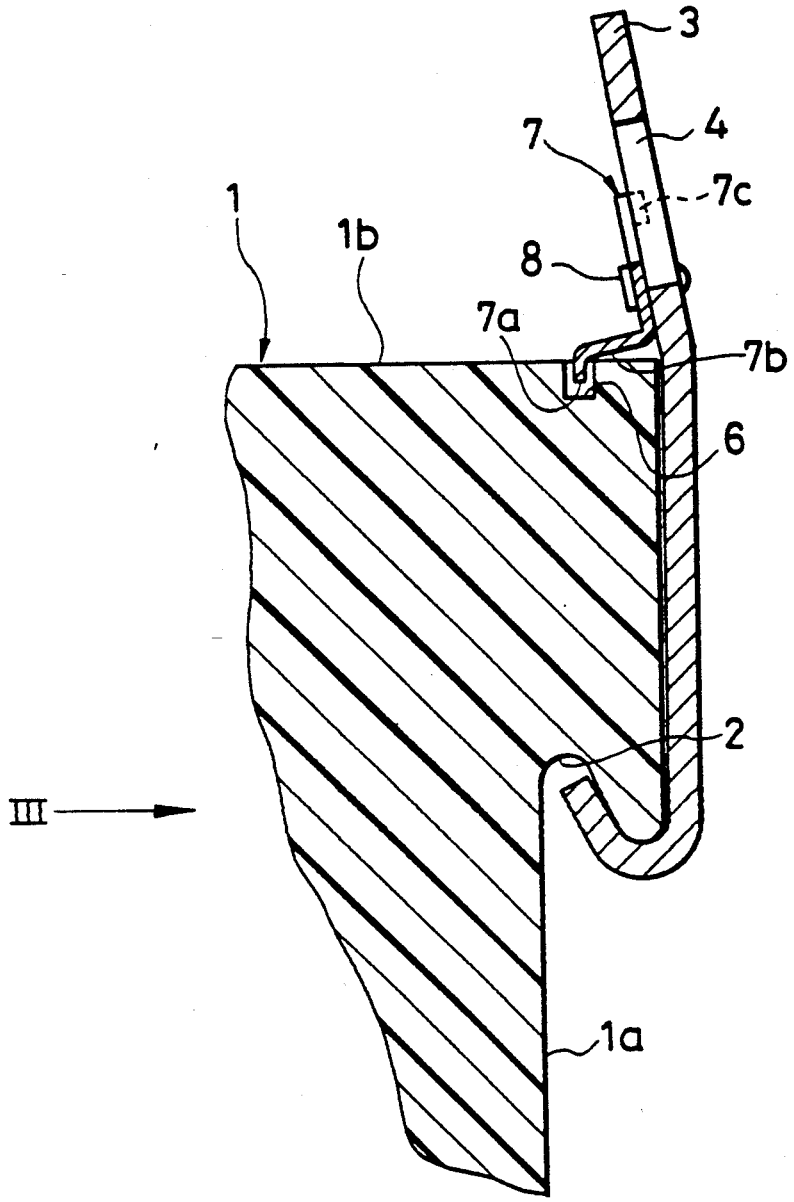
FIG. 2 is a partial sectional side view showing a constitution of the first embodiment of the suspension apparatus.
Figure 3:
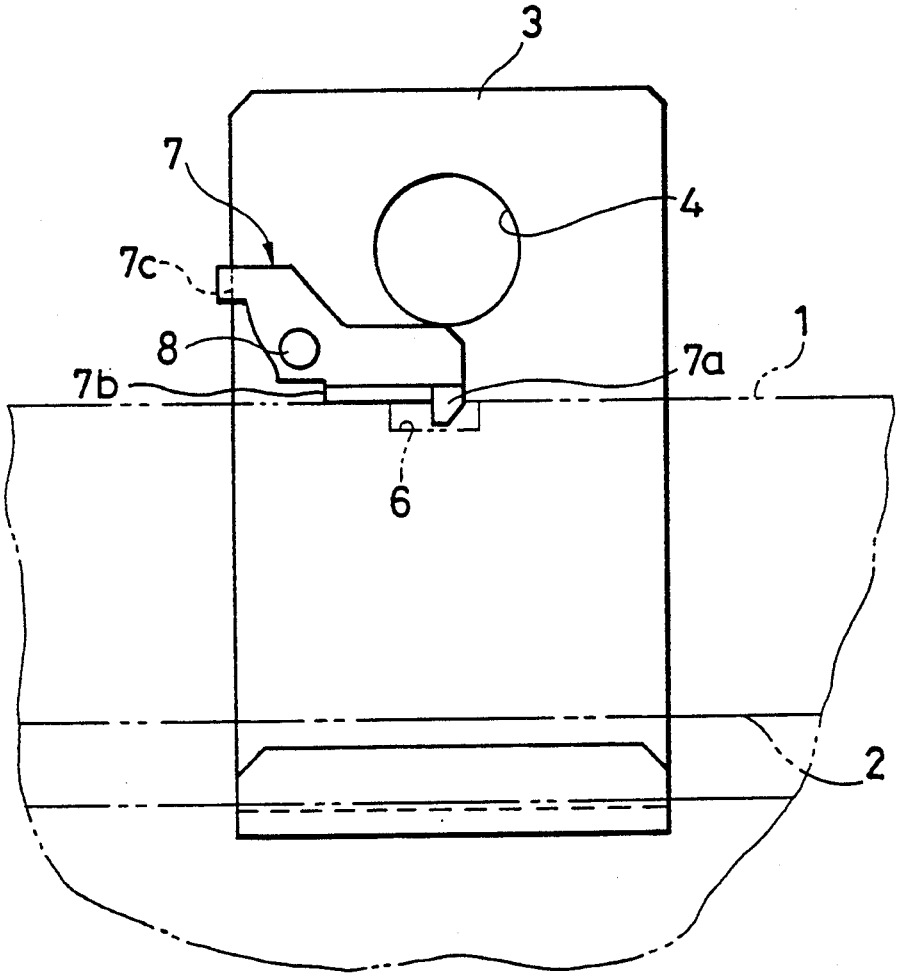
FIG. 3 is a front view of the first embodiment of the suspension apparatus.

A first preferred embodiment of a suspension apparatus in accordance with the present invention is described referring to FIGS. 1, 2 and 3. FIG. 1 is a perspective view showing a suspension of an object by using the first embodiment of the suspension apparatus in accordance with the present invention. FIG. 2 is a partial sectional side view taken along line II—II of FIG. 1. FIG. 3 is a front view of the first embodiment of the suspension apparatus which is seen from a direction shown by arrow III in FIG. 1. Elements designated by the same numerals as those of the conventional suspension apparatus are substantially the same.

As is obvious from FIG. 1, a pair of first hollows 2 are provided on both side faces 1*a* of a truck-type circuit breaker 1. As shown in FIG. 2, each first hollow 2 is formed by an overhang from a side face over the bottom of the circuit breaker. A pair of suspension adapters 3, which have a substantially J-shaped cross-section, are respectively engaged with the hollows 2 from below. As shown in FIG. 3, each suspension adapter 3 has a hole 4, so that a rope or wire 5 is tied to the adapter 3 through the hole 4. As is also obvious from FIG. 1, a pair of second hollows 6 are provided on the upper face in the vicinity of the boundaries between the side faces 1*a* and a top face 1*b* of the circuit breaker 1. A stopper 7, which is substantially a hook lever, is rotatably held so as to cradle around a pivot 8 on each suspension adapter 3. The stopper 7 has a hook 7*a* which is to be engaged with the second hollow 6 of the circuit breaker 1. Furthermore, the stopper 7 has another hook 7*c* which is to be engaged with the suspension adapter 3 and a flat part 7*b*.

As shown in FIGS. 1, 2 and 3, when the suspension adapter 3 is engaged with the first hollow 2 and the hook 7*a* of the stopper 7 is also engaged with the second hollow 6 of the circuit breaker 1, the suspension adapter 3 is firmly coupled with the circuit breaker 1. Therefore, even when the rope or wire 5 is loosened, the suspension adapter 3 is not detachable from the circuit breaker 1.

For detaching the suspension adapter 3 from the circuit breaker 1, the stopper 7 is manually rotated, for example, in a counterclockwise direction in FIG. 3, and thereby, the hook 7*a* is disengaged from the hollow 6 of the circuit breaker. The suspension adapter 3 falls by gravity when the rope or wire 5 is loosened, similarly to the conventional suspension apparatus.

Figure 4:
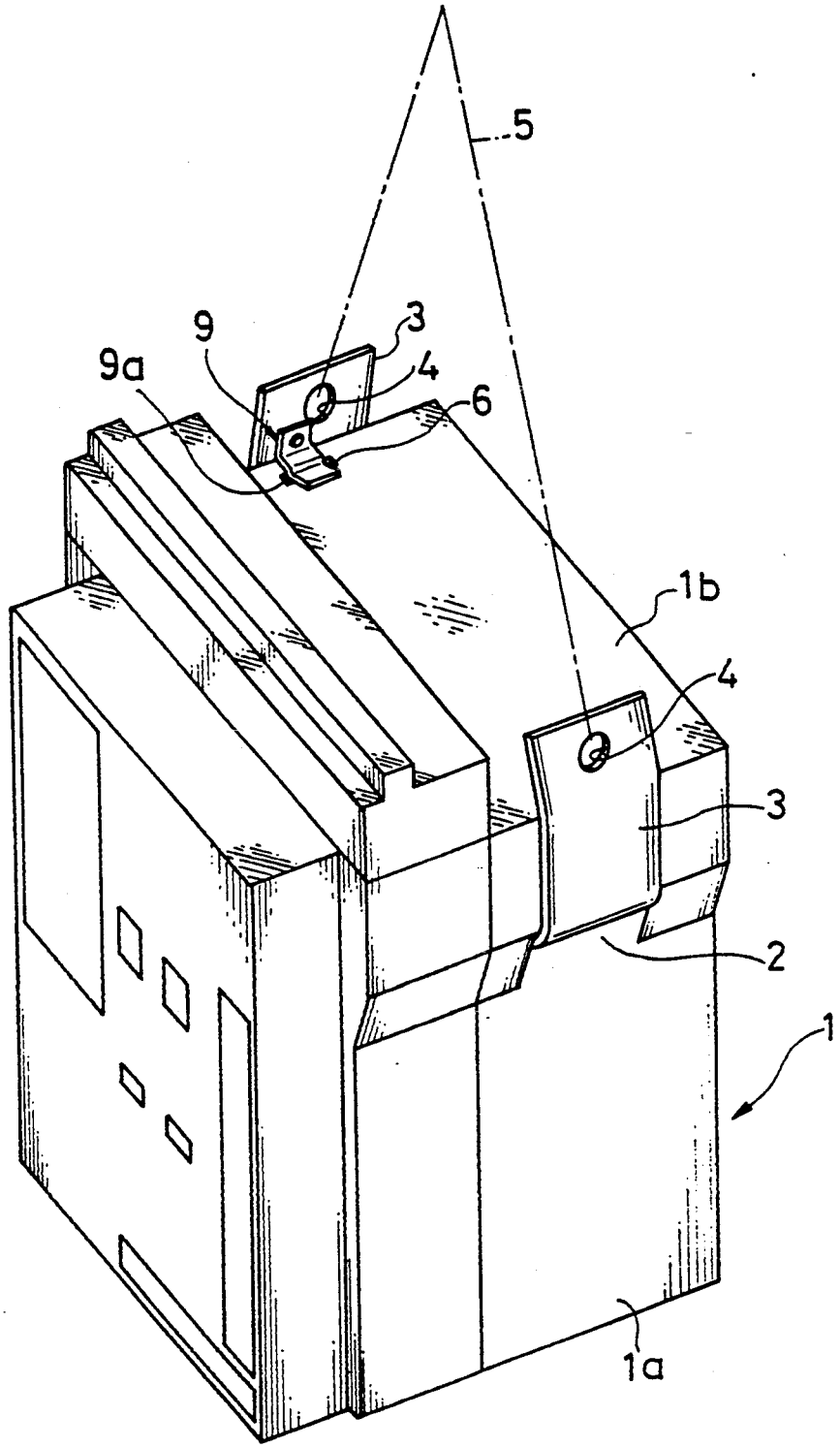
FIG. 4 is a perspective view showing a suspension of an object by using a second embodiment of a suspension apparatus in accordance with the present invention.
Figure 5:
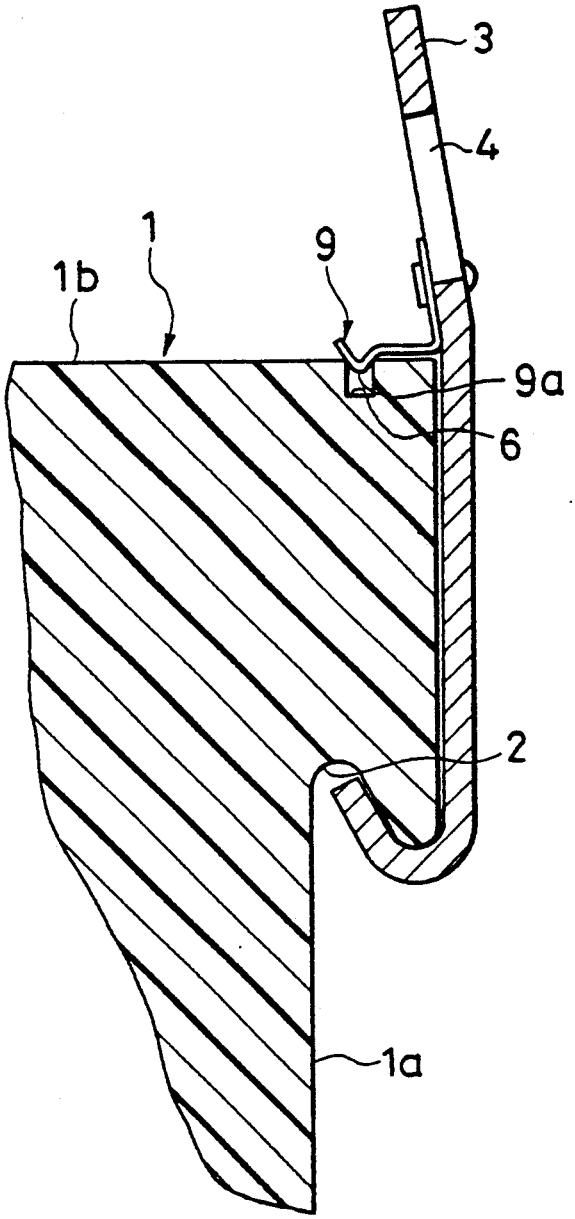
FIG. 5 is a partial sectional side view showing a constitution of the second embodiment of the suspension apparatus.
Figure 6:
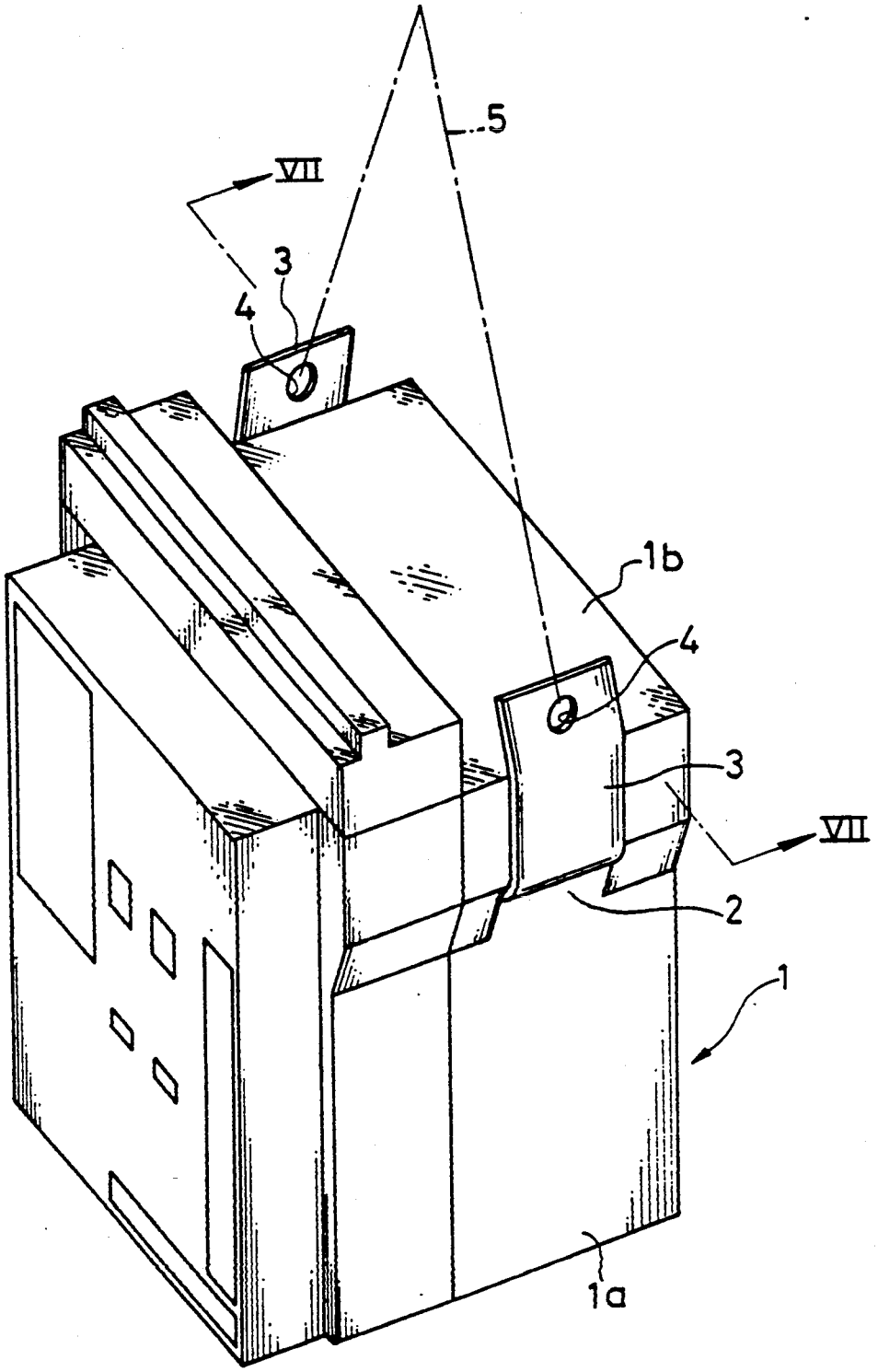
FIG. 6 PRIOR ART
FIG. 6 is a perspective view showing the suspension of the object by the conventional suspension apparatus.
Figure 7:
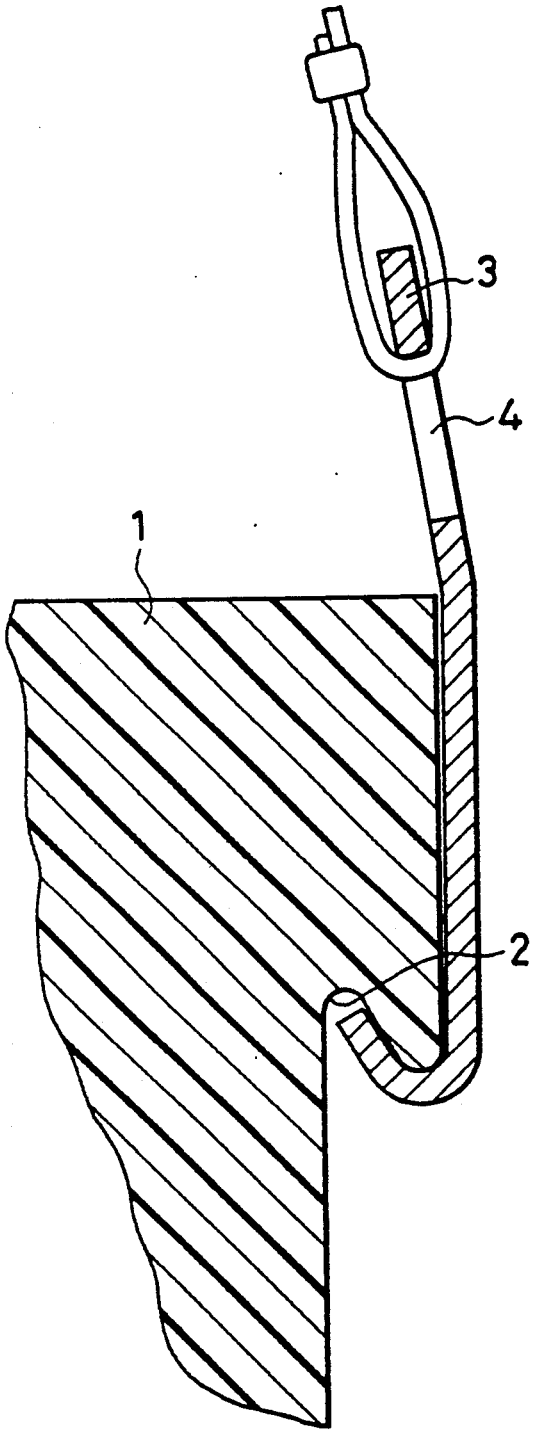
FIG. 7 PRIOR ART
FIG. 7 is a partial sectional side view showing the constitution of the conventional suspension apparatus.

A second preferred embodiment of a suspension apparatus in accordance with the present invention is described referring to FIGS. 4 and 5. FIG. 4 is a perspective view showing suspension of an object by using the second embodiment of the suspension apparatus in accordance with the present invention. FIG. 5 is a partial sectional side view showing a constitution of the second embodiment. Elements designated by the same numerals as that of the above-mentioned first embodiment of the suspension apparatus are substantially the same, so that further explanation of them is omitted.

As shown in FIGS. 4 and 5, a stopper 9, which is made of a resilient material and has a substantially L-shaped cross-section, is fixedly mounted on the suspension adapter 3 in a manner that a protrusion 9*a* of the stopper 9 is to be engaged with the second hollow 6 of the circuit breaker 1.

As shown in FIG. 5, when the suspension adapter 3 is engaged with the first hollow 2 and the protrusion 9*a* of the stopper 9 is also engaged with the second hollow 6 of the circuit breaker 1, the suspension adapter 3 is firmly coupled with the circuit breaker 1. Therefore, even when the rope or wire 5 is loosened, the suspension adapter 3 is not detachable from the circuit breaker 1. For detaching the suspension adapter 3 from the circuit breaker 1, the suspension adapter 3 with stopper 9 is forcibly rotated, for example, in a clockwise direction in FIG. 5, and thereby, the protrusion 9*a* of the stopper 9 is disengaged from the hollow 6 of the circuit breaker. The suspension adapter 3 then falls by gravity when the rope or wire 5 is loosened, similarly to the above-mentioned first embodiment.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. In combination, a suspension apparatus and an object to be suspended, said combination comprising:
   - an object to be suspended;
   - a pair of first hollows respectively provided on opposite side faces of said object to be suspended;
   - a pair of second hollows respectively provided on an upper face of said object in the vicinity of a respective boundary between the upper face and a respective one of said side faces of said object;
   - a pair of suspension adapters each having a hook to be engaged with said first hollows provided at one end thereof and means for securing a suspending member in the vicinity of a second end; and
   - a pair of stoppers respectively provided on said suspension adapters in the vicinity of said second end for engaging with the second hollows and preventing automatic disengagement of said hooks on said suspension adapters from said first hollows when the suspending member is slackened and the object is lowered from a suspended position.

2. A combination in accordance with claim 1, wherein
   - each of said stoppers comprise a hook lever which is rotatably held on said suspension adapter and has a hook part to be engaged with said second hollow.

3. A combination as claimed in claim 2 wherein said the second end of each of said suspension adapters has a substantially planar body portion.

4. A combination as claimed in claim 3 wherein said hook lever is adapted to rotate in a plane substantially parallel to the substantially planar body portion of its respective suspension adapter.

5. A combination in accordance with claim 1, wherein
   - each of said stoppers is made of resilient material, is substantially L-shaped, and has a protrusion in the vicinity of an end thereof in a manner to be engaged with said second hollow.

6. A combination as claimed in claim 5 wherein said the second end of each of said suspension adapters has a substantially planar body portion.

7. A combination as claimed in claim 6 wherein each of said stoppers is fixedly mounted on the substantially planar body portion of the second end of its respective suspension adapter.

8. In combination, a suspension apparatus and an object to be suspended, said combination comprising:
   - an object to be suspended;
   - a pair of first hollows respectively provided on opposite side faces of said object to be suspended;
   - a pair of second hollows respectively provided on an upper face of said object, each in the vicinity of a respective boundary between said upper face and a respective one of said opposed side faces of said object; and
   - a pair of suspension adapters, each of said suspension adapters having
     - a hook to be engaged with a respective one of said first hollows provided at one end of said suspension adapter,
     - means in the vicinity of a second end of said suspension adapter for securing said suspension adapter to a suspending member, and
     - a stopper means provided on said suspension adapter in the vicinity of said second end for engaging a respective one of said second hollows and for preventing disengagement of said hook from said respective one of said first hollows despite an absence of suspending force being applied to said suspension member through said suspending member.

* * * * *